United States Patent [19]

Booker

[11] 3,934,522

[45] Jan. 27, 1976

[54] COAL BURNING SYSTEM

[75] Inventor: Leonard Booker, St. Clair, Mich.

[73] Assignee: The Detroit Edison Company, Detroit, Mich.

[22] Filed: Nov. 1, 1974

[21] Appl. No.: 520,000

[52] U.S. Cl. ..... 110/22 R; 110/28 A; 431/186

[51] Int. Cl.[2] ..... F23D 17/00

[58] Field of Search.. 110/22 A, 28 R, 28 A, 104 R, 110/104 B; 431/186, 351, 352

[56] References Cited

UNITED STATES PATENTS

| | | | |
|---|---|---|---|
| 1,213,821 | 1/1917 | Bergman | 110/104 |
| 1,307,365 | 6/1919 | Kinyon | 110/104 |
| 1,680,964 | 8/1928 | Wickland | 110/104 |
| 1,721,879 | 7/1929 | Hazlehurst et al. | 110/104 |
| 1,769,197 | 7/1930 | Wetmore | 110/22 |

FOREIGN PATENTS OR APPLICATIONS

| | | | |
|---|---|---|---|
| 650,833 | 3/1951 | United Kingdom | 110/28 A |

*Primary Examiner*—Kenneth W. Sprague
*Attorney, Agent, or Firm*—Whittemore, Hulbert & Belknap

[57] ABSTRACT

A system for burning fuel particles in which the particles are suspended in a stream of air and projected into the firebox of a heat exchanger. In order to spread the fuel-air mixture, air is directed transversely, and preferably outwardly of the flowing mixture. The fuel is preferably powdered coal.

12 Claims, 2 Drawing Figures

COAL BURNING SYSTEM

BRIEF SUMMARY OF THE INVENTION

Fuel in the form of particles of small size, particularly solid fuel, such as coal which has been pulverized as in a ball mill, is suspended in a stream of air and is projected into the firebox of a heat exchanger such as a boiler. In practice, the air stream is confined in a pipe or conduit, herein referred to as a burner barrel, having an open discharge end facing an opening in the firewall of the firebox. In order to spread the mixture of powdered fuel and air, it has, in the past, been the practice to provide an assembly of conically inclined blades, referred to as an impeller, so as to create an efficiently enlarged and controlled flame from the fuel supply conduit.

Although the fuel, which for the purpose of this disclosure may be considered to be coal, is in the form of a very fine powder, it is nevertheless abrasive in nature, and over a period of time, the impeller became worn and inefficient.

According to the present invention, an air supply tube is provided which is supplied with air under elevated pressure and which extends along the axis of the burner barrel and has a closed end adjacent the discharge end of the burner barrel. A multiplicity of air passages are provided adjacent the closed end of the tube. The passages are preferably inclined rearwardly with respect to the direction of flow through the barrel, and are adapted to form a multiplicity of air jets which have the effect of spreading the fuel-air mixture into a shape which produces an efficient flame.

The air supply tube is longitudinally adjustable to permit adjustment of the flame to its most efficient condition.

DETAILED DESCRIPTION

Figure 1:
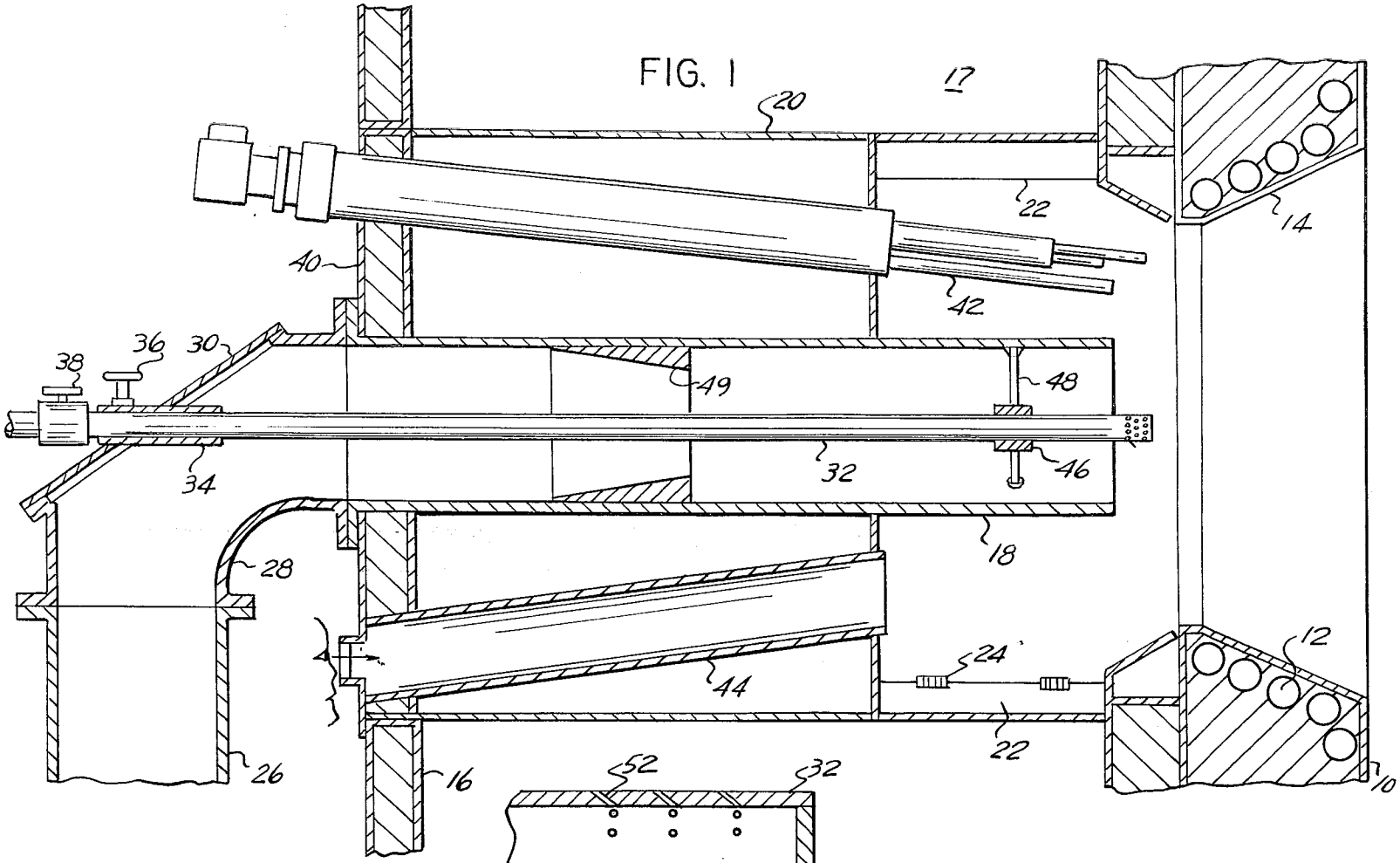
FIG. 1 is a vertical section through a single burner.

Referring now to the drawings there is shown a portion of a firewall 10 of a firebox of a heat exchanger. For purposes of illustration, the burner is illustrated as for use with a boiler, and the firewall of the firebox is illustrated as comprising water tubes 12 surrounding an opening 14 through the firewall. The space between inner wall 10 and an outer wall 16 constitutes a wind box 17 containing air at above atmospheric pressure for supply to the firebox as secondary air to ensure complete combustion of the fuel.

A burner barrel 18 is provided which extends through the outer wall 16 and terminates adjacent the opening 14 in line therewith and in position to project the fuel-air mixture into the firebox. As shown in FIG. 1, the burner barrel 18 is surrounded by a tubular partition 20 provided with secondary air dampers 22 hinged as indicated at 24.

Powdered fuel, such as coal, is produced by a device such as a ball mill (not shown) and is suspended in a stream of air which flows upwardly through a vertical pipe 26 and around an elbow connection 28 which is bolted or otherwise secured to the outer end of burner barrel 18. The elbow 18 is provided with a removable plate 30 which carries air supply tube 32. Tube 32 is longitudinally adjustable in a support 34, so as to provide for adjustment of the flame produced in the firebox, and means 36 are provided for fixing it in adjusted position.

Tube 32 is connected to a supply of air at a pressure substantially above that in the burner barrel, and flow of air through the tube can further be controlled by an adjustable valve 38.

Mounted in a removable register cover 40 at the outer wall 16 is an igniter 42 in which gas or an atomized liquid fuel projects a flame through opening 14 to ignite the fuel-air mixture delivered by burner barrel. Also carried by cover 40 is a view tube 44 through which the flame of the burning fuel-air mixture projected by burner barrel 18 may be viewed for adjustment thereof by adjustment of air tube 32 longitudinally of the burner barrel 18, by adjustment of valve 38, by adjustment of secondari air dampers 22, or by adjustment of the fuel-air mixture supplied from pipe 26.

Within the burner barrel adjacent its inner end is a guide bushing 46 carried by tripod legs 48 fixed to the burner barrel. Bushing 46 slidably supports air tube 32 for adjustment of the flame as previously described.

Preferably, burner barrel 18 is provided with a fuel directing conical baffle 49 which tends to concentrate the fuel-air mixture adjacent the perforated end of air tube 32.

Figure 2:
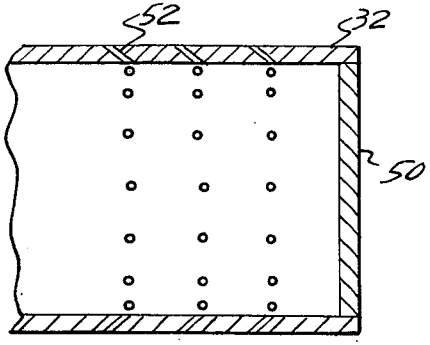
FIG. 2 is an enlarged fragmentary sectional view of the outlet end of the air tube.

Referring now to FIG. 2, there is shown a preferred construction for the inner end of tube 32. The end of the tube is closed, as by end closure plug 50, and a multiplicity of air passages 52 are formed to extend into the interior of the tube 32 from the exterior thereof. As shown, the passages are provided in three rows of sixteen each, and are inclined rearwardly and radially outwardly to project deflecting air jets into the flowing fuel-air mixture in a direction partly opposed to the flow in the burner barrels. As is apparent from this Figure, passages 52 are restricted and their transverse dimension is substantially less than their length. As a consequence the air is directed in jets whose direction follows closely the direction of the passages.

In a practical embodiment of the invention, the air tube 32 is a 2 inch tube, and the passages 52 are 1/32 inch drilled holes inclined at about 45° from the axis of the tube. Three rows spaced ½ inch apart are provided and with sixteen holes in the 2 inch tube, circumferential spacing of adjacent holes in each row is about 0.4 inch. The fuel-air mixture flow through the burner barrel is at about 80–90 feet per minute. Secondary air in the wind box 17 is maintained at a pressure of about 5 inches of water. Air pressure within the air supply tube 32 is at about 45 psi. It is of course to be understood that these values are given merely to suggest possible operating parameters, and may be varied widely in use.

In practice a single firebox may contain several rows of burner units, and in one operating example some sixteen burners are provided in a single firebox.

The construction disclosed herein, where air jets are used as the means for spreading the fuel-air mixture to produce the most efficient shape of flame, represents an important advance over prior practice, affords better control of the shape and size of the flame, and eliminates replacement of wornout deflectors or impellers as has previously been necessary.

What I claim as my invention is:

1. A firebox, a generally tubular burner barrel having an inner end adjacent the inner wall of said firebox and positioned to project fuel particles in a stream of primary air into the firebox for combustion therein a tube extending axially within said barrel for supplying fuel deflecting air under pressure to a zone adjacent the inner end of said burner barrel, said tube having a closed end, and a plurality of restricted air jet passages extending through the wall of said tube and inclined rearwardly and outwardly thereof and opening into the path of flow of the fuel-air mixture.

2. A firebox as defined in claim 1 comprising in addition generally conical fuel directing means within said barrel and shaped to direct the fuel generally inwardly of said barrel toward the nozzle means adjacent the end of said tube.

3. A firebox as defined in claim 1, said barrel having a tube supporting bushing located generally on the axis of the barrel and dimensioned to provide for axial sliding adjustment of the tube in said barrel.

4. A generally cylindrical burner barrel through which a stream of primary combustion air is adapted to carry fuel particles suspended therein to a combustion zone and to project the mixture of air and fuel particles from its inner end into the combustion zone, a tube extending axially of said barrel and having a closed end adjacent the inner end of said barrel, said tube having a multiplicity of outwardly and rearwardly inclined air jet openings adjacent its closed end to direct air jets outwardly into the stream of air and fuel particles in a direction opposed to the direction of the stream flow of air and fuel particles.

5. A burner barrel as defined in claim 4 comprising a tube guide bushing located on the axis of said barrel, and dimensioned to provide for axial adjustment of the tube, in which the inner end of said tube is of the same diameter as intermediate portions thereof to provide for insertion and removal of air tubes through said bushing.

6. A burner barrel as defined in claim 4, said barrel having a transverse wall adapted to be located outside a firebox provided with the barrel, said transverse wall having an opening therethrough in alignment with the barrel, the portion of said tube within said barrel being of uniform diameter to provide for axial adjustment and removal and/or replacement of the tube while the burner remains in service.

7. A burner as defined in claim 6 comprising a tube guide bushing located on the axis of said barrel, and dimensioned to provide for axial adjustment of the tube, in which the inner end of said tube is of the same diameter as intermediate portions

8. A burner barrel as defined in claim 4, said barrel having a generally conical deflector spaced outwardly from the inner end of said tube shaped to direct the fuel-air mixture in said barrel generally toward the inner end of said tube.

9. The method of controlling the shape of a flame within a firebox which comprises directing a stream of air-fuel particle mixtures through a tubular barrel having an inner end through which the mixture is projected into the firebox, and spreading the mixture as it emerges from the inner end of said barrel by projecting mixture-deflecting air into the mixture stream transversely thereof in directions having components rearward with respect to flow of the mixture stream.

10. The method as defined in claim 9 which comprises projecting the mixture deflecting air from a zone within the mixture stream in directions outwardly from the axis thereof.

11. The method of burning powdered fuel which comprises directing a stream of air in which powdered fuel particles are suspended toward a firebox, restricting the stream to form the stream into a column of uniform cross-section, modifying the shape of the column to concentrate the stream of air and suspended fuel particles at a zone adjacent to an entry port into the firebox, and providing in said zone supplementary air jet means directed transversely of the direction of flow of said stream from a location substantially within the zone at which the air and suspended fuel particles are concentrated to produce controlled scattering of said powdered fuel to produce a flame of desired shape and dimensions.

12. The method as defined in claim 11 which comprises directing the multiplicity of air jets outwardly from the zone and rearwardly with respect to the direction of flow of the stream of air and suspended particles.

* * * * *